US008052251B2

(12) United States Patent
Kudo et al.

(10) Patent No.: US 8,052,251 B2
(45) Date of Patent: Nov. 8, 2011

(54) INK JET RECORDING HEAD

(75) Inventors: Kiyomitsu Kudo, Machida (JP); Yukuo Yamaguchi, Tokyo (JP); Genji Inada, Koshigaya (JP); Mikiya Umeyama, Tokyo (JP); Masaru Iketani, Atsugi (JP); Satoshi Kudo, Sagamihara (JP); Yuichiro Akama, Kawasaki (JP); Chiaki Muraoka, Kawaguchi (JP); Satoshi Kimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1127 days.

(21) Appl. No.: 11/835,148

(22) Filed: Aug. 7, 2007

(65) Prior Publication Data

US 2008/0252698 A1 Oct. 16, 2008

(30) Foreign Application Priority Data

Aug. 23, 2006 (JP) ..... 2006-226532

(51) Int. Cl.
*B41J 2/14* (2006.01)

(52) U.S. Cl. ..... 347/65

(58) Field of Classification Search ..... 347/20, 347/65, 66, 67

See application file for complete search history.

(56) References Cited

U.S. PATENT DOCUMENTS

| | | | | |
|---|---|---|---|---|
| 4,468,680 | A * | 8/1984 | Martner | 347/68 |
| 5,030,317 | A * | 7/1991 | Noguchi | 216/27 |
| 5,208,604 | A * | 5/1993 | Watanabe et al. | 347/47 |
| 5,478,606 | A | 12/1995 | Ohkuma et al. | |
| 5,754,205 | A * | 5/1998 | Miyata et al. | 347/70 |
| 5,826,333 | A | 10/1998 | Iketani et al. | |
| 5,847,723 | A * | 12/1998 | Akahira et al. | 347/14 |
| 5,988,798 | A | 11/1999 | Hirasawa et al. | |
| 6,419,347 | B2 | 7/2002 | Ono et al. | |
| 6,601,945 | B2 | 8/2003 | Kitakami | |
| 6,663,217 | B2 * | 12/2003 | Otsuka et al. | 347/29 |
| 7,673,975 | B2 * | 3/2010 | Hashizume et al. | 347/71 |

FOREIGN PATENT DOCUMENTS

JP 6-286149 10/1994

* cited by examiner

*Primary Examiner* — Anh T. N. Vo
(74) *Attorney, Agent, or Firm* — Fitzpatrick, Cella, Harper & Scinto

(57) ABSTRACT

An ink jet recording head includes an element substrate; a plurality of ejection outlets, provided on the element substrate, for ejecting ink in a direction perpendicular to the element substrate; and a nozzle formation member having a plurality of ink flow paths which are in fluid communication with the ejection outlets, respectively. The ink flow paths are arranged at a density higher than 1200 dpi in an arranging direction of the ejection outlets and widths of flow passage walls forming the ink flow paths are smaller than heights of the ink flow paths and are smaller than widths of the ink flow paths.

2 Claims, 9 Drawing Sheets

INK JET RECORDING HEAD

FIELD OF THE INVENTION AND RELATED ART

The present invention relates to an ink jet recording head which records on recording medium by adhering liquid, such as ink, from its liquid jetting orifices.

Nowadays, an ink jet recording apparatus is widely used. One of the ink jet recording methods employed by an ink jet recording apparatus is the ink jetting method which uses an electro-thermal transducer as the element for generating the energy for jetting liquid. The ink jet recording apparatus which uses this ink jet recording method employs an ink jet recording head structured as follows: The ink jet recording head is provided with: a substrate formed of silicon (which hereafter may be referred to simply as substrate); electro-thermal transducers formed on the substrate; and a nozzle forming member (which hereafter may be referred to as orifice plate) formed on the substrate, of epoxy resin or the like (Patent Document 1). The orifice plate has: multiple orifices for jetting liquid in the direction perpendicular to the orifice plate; multiple ink passages which lead to the orifices, one for one, and each of which has a pressure chamber (bubble generation chamber); and a common liquid chamber which is on the upstream side of the ink passages and stores liquid. The combination of the orifice, and the ink passage which leads to the orifice, is referred to as a nozzle. The silicon substrate has a liquid delivery hole through which liquid is delivered to the common liquid chamber.

In recent years, it has been desired to improve an ink jet recording apparatus in terms of the level of quality at which it records, and also, in terms of printing speed. Thus, not only has an ink jet recording head been increased in nozzle count, but also, in nozzle density.

Patent Document: Japanese Laid-open Patent Application H06-286149

However, as an ink jet recording head has been increased in nozzle density and nozzle count, the wall of each ink passage has been reduced in thickness, and also, the ink jet recording head chip has been increased in size. The reduction in the thickness of the ink passage wall and the increase in chip size are likely to cause the problem that the nozzle formation plate (which hereafter will be referred to as nozzle plate) separates from the silicon substrate due to changes in the temperature and humidity of the environment in which an ink jet recording head is used, and the permeation of ink into the interface between the nozzle plate and substrate. Incidentally, occurrences of this problem have been confirmed.

FIGS. 10, 11A, and 11B show the general structure of a comparative ink jet recording head chip, or an ink jet recording head chip in accordance with the prior art. This chip is for dye-based color ink. It has six ink delivery channels and 2,304 (256×9) ink jetting orifices. More specifically, a row of 128 ink jetting orifices is placed on each side of each ink delivery channel 9 with a pitch of 600 dpi (roughly 43 μm in interval). The chip is 8.5 mm in "vertical" direction and 8.7 mm in "horizontal" direction. The amount of ink which each ink jetting orifice jets per jetting is 5.7 Pl. The width of each ink passage 12 is 32 μm, and the diameter of each ink jetting orifice 10 is 17.2 μm. The height of the ink passage 12 is 14 μm. The thickness (distance between ceiling surface of pressure chamber of ink passage 12, and top surface of nozzle plate 8, where ink jetting orifices 10 are open) of the ink jetting orifice portion is 11 μm. The thickness of the nozzle plate 8 itself is 25 μm. The width (thickness) of each ink passage wall 13 is 10 μm. The surfaces of the ink passage wall, which are parallel to the ink passage, have an angle of 6°; the ink passage wall 13 is tapered in cross section. The abovementioned width of the ink passage wall 13 is the measurement taken at the interface between the ink passage wall 13 and substrate 7, and the abovementioned width of the ink passage 12 is the measurement taken at the surface of the substrate 7. Thus, the abovementioned width of the ink passage 12 is the width of the widest portion of the ink passage 12. There is an adhesion improvement layer 17 between the nozzle plate 8 and substrate 7. The adhesion improvement layer is formed of epoxy resin.

There has been concern for the problem that the nozzle plate 8 of this chip might separate from the substrate 7 due to the heat history of the chip during the manufacture of the chip, the difference between silicon (of which substrate 7 if formed) and epoxy resin (of which nozzle plate 8 is formed), in terms of the thermal expansion caused by the heat to which they are subjected during the manufacturing of the chip, the changes in the temperature and humidity of the environment in which the chip is used, and like factors. However, this chip is not as large as recent chips. Therefore, the problem did not occur.

However, when another ink jet recording head chip in accordance with the prior art was tested for the nozzle plate separation, the nozzle plate separation occurred. More specifically, this chip was the same in ink jetting orifice pitch as the one shown in FIGS. 10 and 11A. However, the number of the nozzles in each nozzle row was 256, that is, a total of 512 nozzles per ink delivery channel. The chip size was 9.5 mm (in "vertical" direction)×14.5 mm (in "horizontal" direction). When this chip was tested, the separation of the nozzle plate 8 attributable to its heat history during the manufacturing of the chip occurred. Further, it became evident that the separation occurred because the interface between the silicon (of which substrate is formed) and epoxy resin (of which nozzle plate is formed) was stressed by the difference in the amount of thermal expansion between the silicon and epoxy resin, and the interface could not withstand the stress.

FIG. 12 is a schematic sectional view of a given section of the ink jet recording head chip in accordance with the prior art, showing the separation of the nozzle plate 8 from the substrate 7. FIG. 12 shows the nozzle filters 14 (hatched portions in drawing) which separated from the substrate 7, and the end portions (hatched portions in drawing) of the ink passage walls 13, which separated from the substrate 7. If a printing operation is carried out using an ink jet recording chip which is in the above described condition, the pressure generated by the bubbles generated by the electro-thermal transducer in one ink passage affects the next ink passages. Therefore, the chip becomes unstable in ink jetting performance, causing thereby the ink jet recording apparatus to output an image which is substantially low in quality. In other words, the separation of the nozzle plate 8 is one of the primary causes which substantially reduce an ink jet recording apparatus in image quality.

Incidentally, some ink jet recording heads are provided with a protective tape for preventing ink from evaporating through the ink jetting orifices between the time of their manufacture and the time of their delivery to a user. The protective tape is pasted on the surface of the head, which has the openings of the ink jetting orifices. It was confirmed that in the case of these ink jet recording heads, there is concern for the problem that the nozzle plate 8 is separated from the substrate 7 when the protective tape is peeled.

SUMMARY OF THE INVENTION

Thus, the primary object of the present invention, which was made in consideration of the problems described above, is to minimize the problem that in the case of an ink jet recording head which has a high nozzle count and a high nozzle density, its nozzle plate formed on its substrate separates from the substrate during its distribution, and also, while it is used.

According to an aspect of the present invention, there is provided an ink jet recording head comprising an element substrate; a plurality of ejection outlets, provided on said element substrate, for ejecting ink in a direction perpendicular to said element substrate; and a nozzle formation member having a plurality of ink flow paths which are in fluid communication with said ejection outlets, respectively; wherein said ink flow paths are arranged at a density higher than 1200 dpi in an arranging direction of said ejection outlets; wherein widths of flow passage walls forming said ink flow paths are smaller than heights of said ink flow paths and are smaller than widths of said ink flow paths.

Thus, the present invention makes it possible to improve an ink jet recording head in terms of the adhesion between its substrate, and its nozzle plate formed on the substrate, in order to minimize the problem that the nozzle plate of the ink jet recording head separates from the substrate of the ink jet recording head during the shipment of the head, and while the head is used. Therefore, the present invention can provide a very reliable high resolution ink jet recording head.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Embodiment 1

Figure 1:
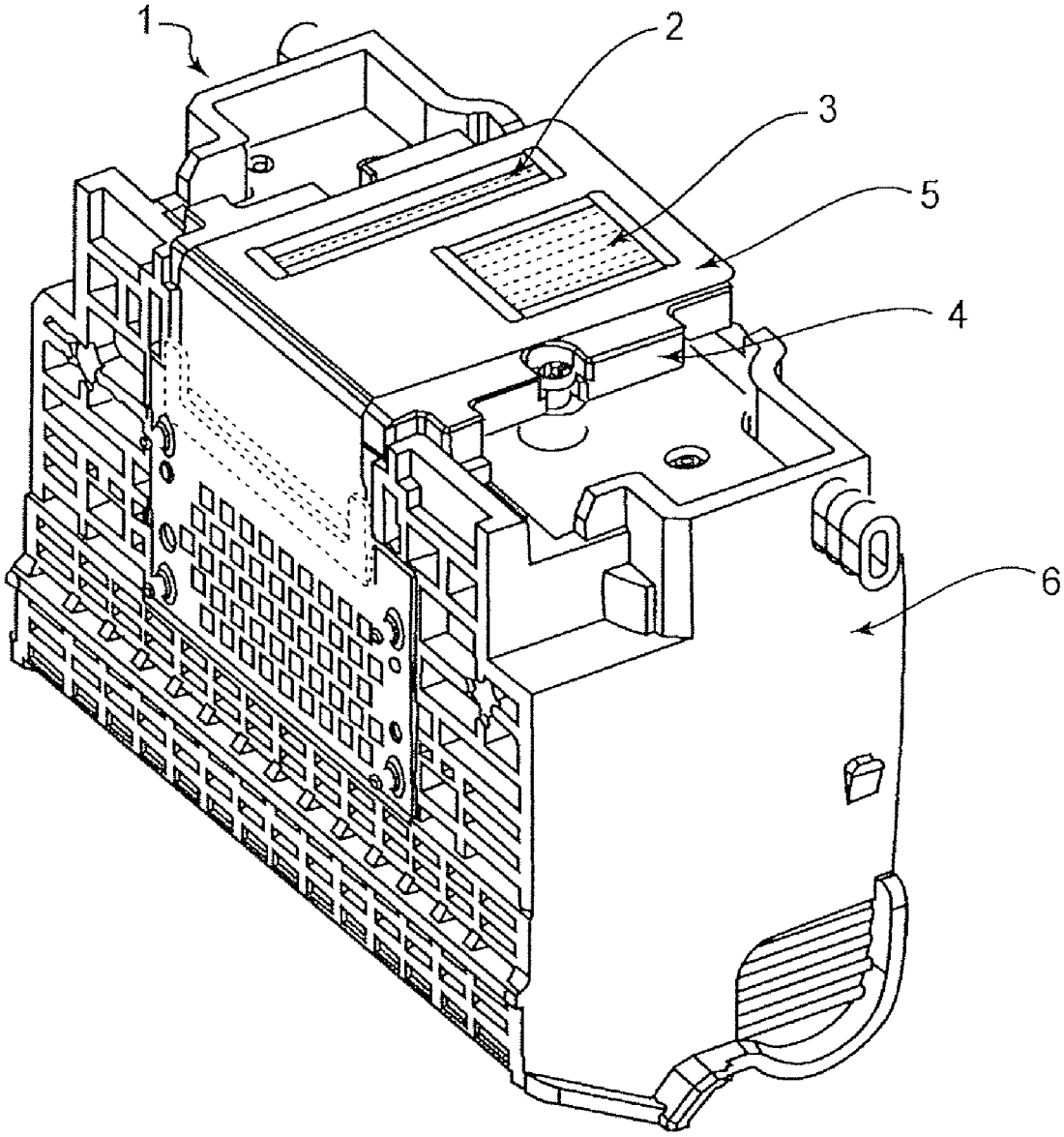
FIG. 1 is a perspective view of the ink jet recording head in the first preferred embodiment of the present invention.
Figure 2A:
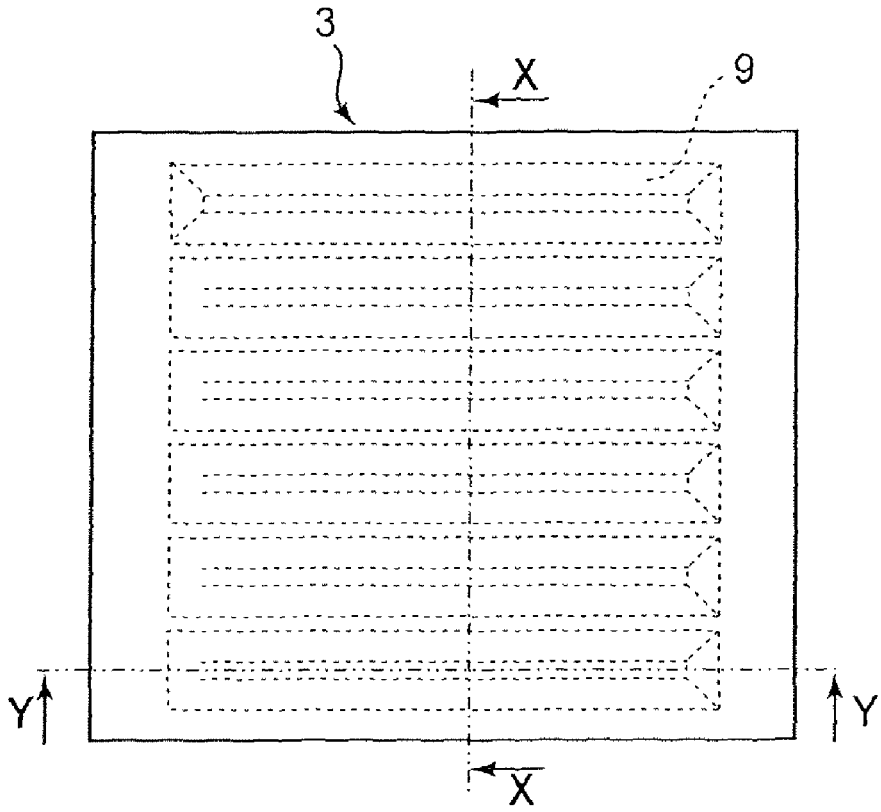
FIG. 2A is a plan view of the ink jet chip, shown in FIG. 1, which is for dye ink.
Figure 2B:
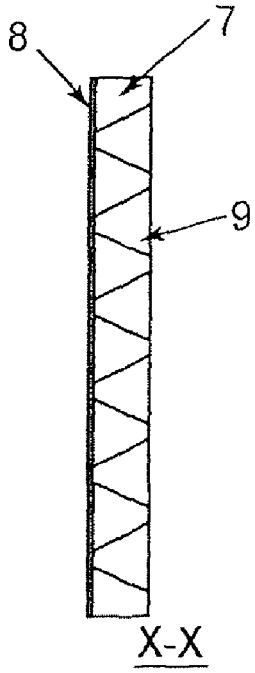
FIG. 2B is a sectional view of the ink jet chip shown in FIG. 2A, at Plane X-X in FIG. 2A.
Figure 2C:
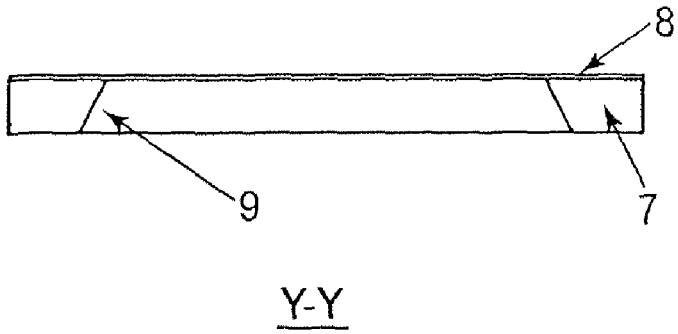
FIG. 2C is a sectional view of the ink jet chip shown in FIG. 2A, at Plane Y-Y.
Figure 3:
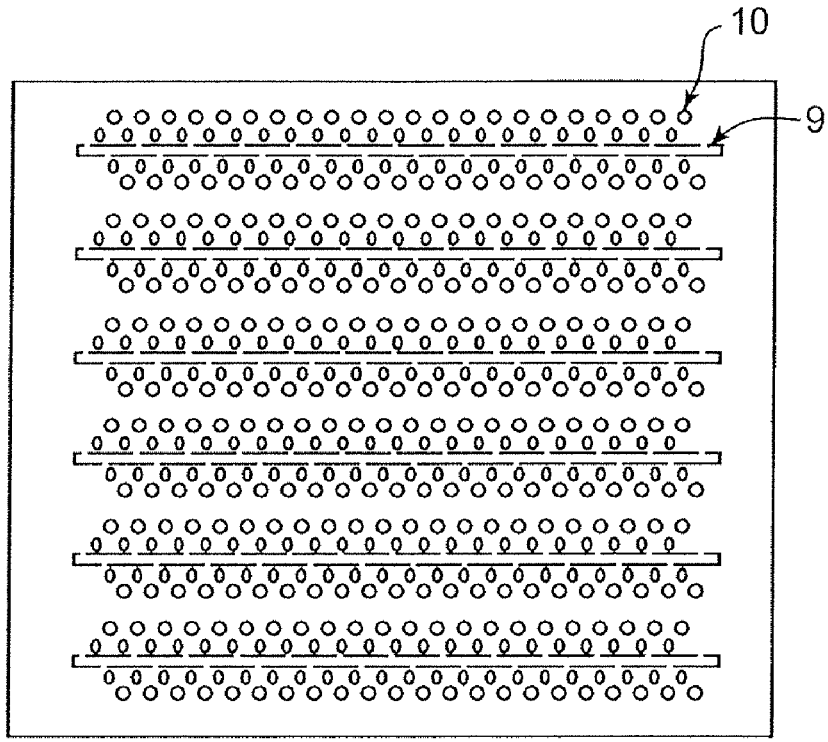
FIG. 3 is a plan view of the ink jet chip for dye ink, shown in FIG. 1, showing the nozzle arrangement of the chip.

FIG. 1 is a perspective view of the ink jet recording head in the first preferred embodiment of the present invention. The ink jet recording head 1 is provided with a chip 2 and a chip 3. The chip 2 is for jetting pigment-based black ink, and the chip 3 is for dye-based color inks.

The chip 2 is provided with an ink delivery channel and multiple ink jetting nozzles (which hereafter will be referred to simply as nozzles). The multiple nozzles are arranged in two rows, and one row of nozzles is placed on one side of the ink delivery channel and the other row is placed on the other side of the ink delivery channel. Each nozzle is provided with a pressure chamber (bubble generation chamber) and an ink passage. The pressure chamber is provided with a heater as the element for generating the energy for jetting ink. The total number of the nozzles of the chip 2 is 512. One half of the nozzles, or 256 nozzles, are arranged on one side of the ink delivery channel with a pitch of 300 dpi (with interval of roughly 84 μm), and the other half are on the other side of the ink delivery channel with the same pitch. The primary usage of the pigment-based black ink is for printing texts, or the like. Therefore, the chip 2, or the chip for jetting pigment-based black ink, is not required to print at a level as high as the level at which pictorial images are required to be printed. The amount by which ink is jetted by each of the nozzles of the chip 2 per jetting is roughly 30 pl, which is rather large compared to 1-5 pl by which dye-based ink is jetted per jetting by each of the nozzles of the chip 3, or the chip for jetting dye-based inks. Thus, the chip 2 is greater in nozzle size than the chip 3.

At this time, the method for manufacturing the abovementioned chips will be briefly described. First, heaters, and driver portions for driving the heaters, are formed on a piece of silicon wafer with the use of a semiconductor manufacturing process. Then, a mold layer for forming nozzles (ink passages having a pressure chamber which includes a heater) and common liquid chamber (liquid storage chamber which is in connection to multiple ink passages) is formed by patterning (photolithographic technology). Then, nozzle formation material is coated on the silicon wafer in a manner to cover the mold. Then, the orifices are formed by patterning. Then, the ink delivery channel, which is a through hole for supplying the common liquid chamber with ink, is formed in the silicon wafer, from the rear side of the wafer. Then, the mold is removed. Finally, the silicon wafer is diced to separate the multiple chips into individual pieces. As the nozzle formation material, epoxy resin is used.

Each of the completed chips is solidly adhered to a base member 4 formed of aluminum, and is connected to a TAB tape for transmission of electrical power and signals. The electrically connective portion and the peripheries of the chip are sealed with sealing agent to prevent ink or the like from entering the chip. In the abovementioned adhering process and sealing process, the chip is subjected to a high temperature which is in a range of 100° C.-150° C.

Then, the completed unit is connected to an ink container 6 to complete the ink jet recording head 1.

FIGS. 2A-2C, and 3 show the general structure of the chip 3, that is, the chip for dye-based inks. The chip 3 is made up of a substrate 7 and a nozzle plate 8. The substrate 7 is provided with multiple ink delivery channels 9 for supplying the nozzles with ink. In this embodiment, the total number of ink delivery channels 9 is 6: one for photographic black ink, one for yellow ink, two for magenta ink, and two for cyan ink.

The chip 3, or the chip for dye-based ink, is also provided with multiple ink delivery channels, and multiple ink jetting nozzles (which hereafter will be referred to simply as nozzles), as is the chip 2, or the chip for the pigment-based ink. The multiple nozzles (orifices) 10 are arranged on both sides of each ink delivery channel 9. Each nozzle is provided with a pressure chamber and an ink passage. The pressure chamber is provided with a heater as the element for generating the energy for jetting ink. The total number of the nozzles of the chip 3 per ink delivery channel is 1024. One half of the nozzles, or 512 nozzles, are arranged on one side of the ink delivery channel 9 with a pitch of 1,200 dpi (with interval of roughly 21 μm), and the other half are on the other side of the ink delivery channel 9 with the same pitch. The chip 3 is 9.5 mm in the direction perpendicular to the lengthwise direction of the ink delivery channel 9, and 14.5 mm in the direction parallel to the lengthwise direction of the ink delivery channel 9.

Figure 4A:
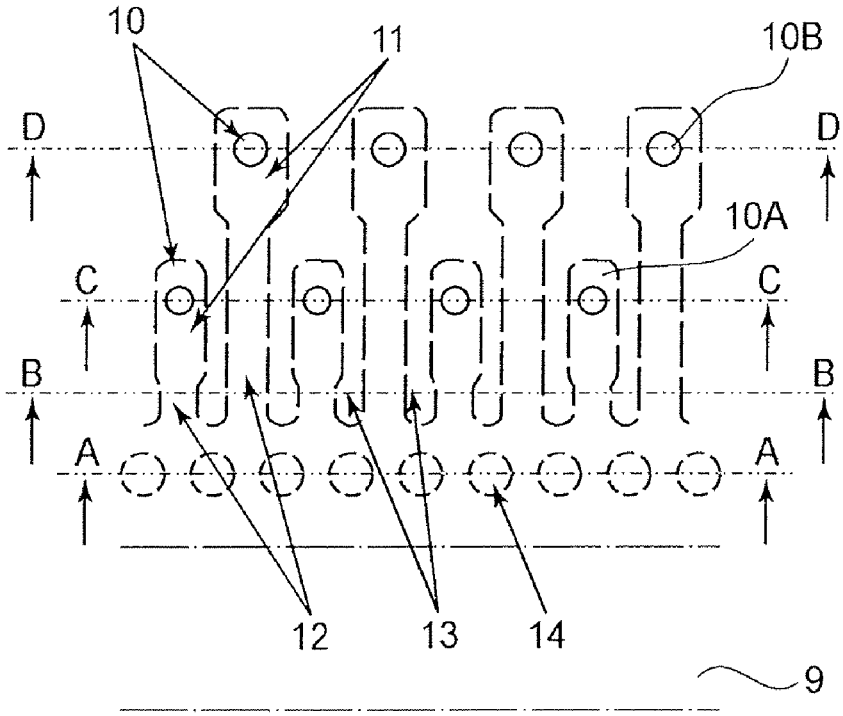
FIG. 4A is a top view of a given section of the ink jet chip in the first preferred embodiment, as seen from the top side of the nozzle formation member (nozzle plate), showing the nozzles and its adjacencies.
Figure 4B:
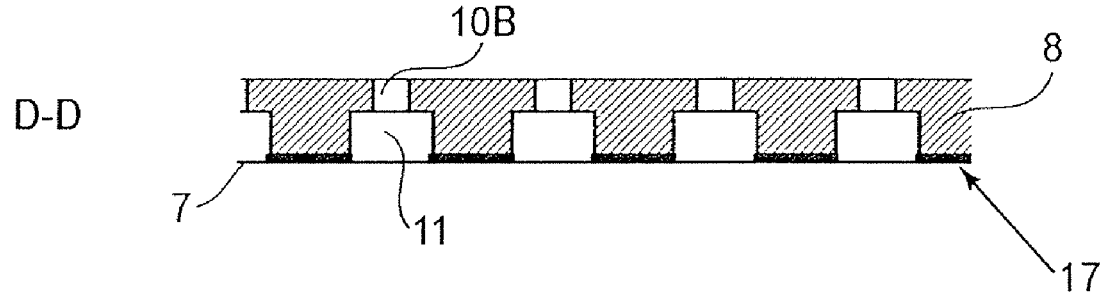
FIG. 4B is a sectional view of the same section of the ink jet chip as the one shown in FIG. 4A, at Plane D-D in FIG. 4A.
Figure 4C:
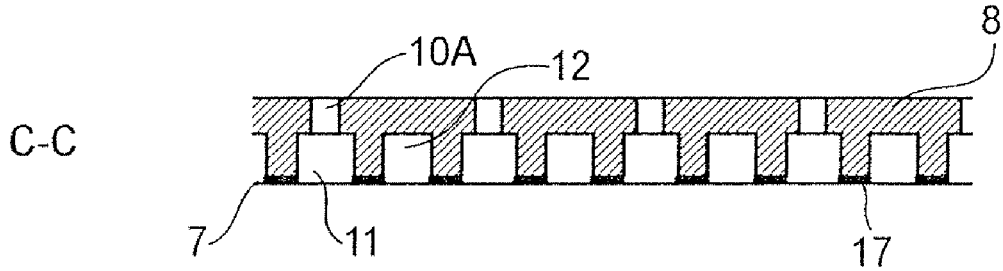
FIG. 4C is a sectional view of the same section of the ink jet chip as the one shown in FIG. 4A, at Plane C-C in FIG. 9A.
Figure 4D:
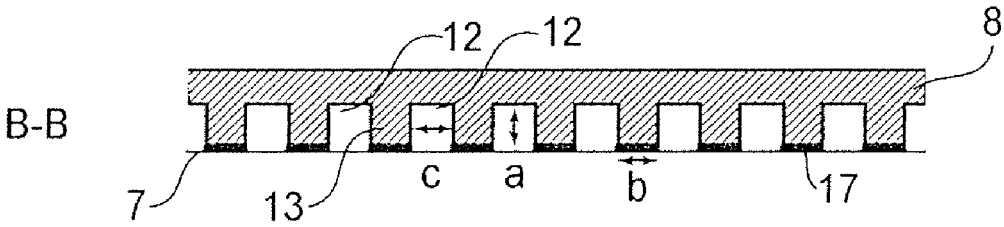
FIG. 4D is a sectional view of the same section of the ink jet chip as the one shown in FIG. 4A, at Plane B-B in FIG. 4A.
Figure 4E:
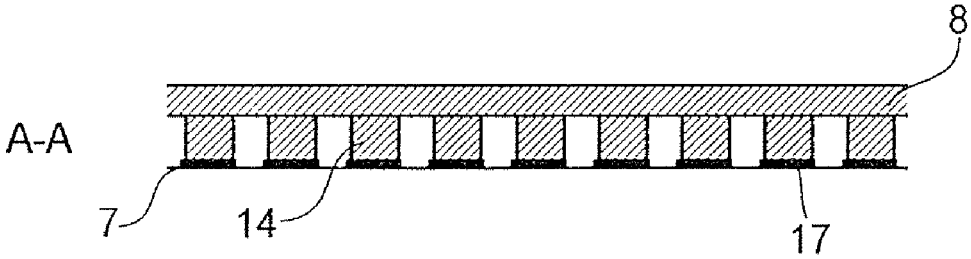
FIG. 4E is a sectional view of the same section of the ink jet chip as the one shown in FIG. 4A, at Plane A-A in FIG. 4A.

FIG. 4A is a schematic top view of a given section of the chip for dye-based ink, as seen from the top side of the nozzle plate, showing the nozzles and its adjacencies. FIG. 4B is a sectional view of the same section of the chip as the one shown in FIG. 4A, at Plane D-D in FIG. 4A. FIG. 4C is a sectional view of the same section of the chip as the one shown in FIG. 4A, at Plane C-C in FIG. 4A. FIG. 4D is a sectional view of the same section of the chip as the one shown in FIG. 4A, at Plane B-B in FIG. 4A. FIG. 4E is a sectional view of the same section of the chip as the one shown in FIG. 4A, at Plane A-A in FIG. 4A.

Referring to FIG. 4A, there are two rows of ink jetting orifices 10, that is, a row of ink jetting orifices 10A and a row of ink jetting orifices 10B, on each side of the ink delivery channel 9. The row of ink jetting orifices 10A is closer to the ink delivery channel (or supply port) 9 than the row of ink jetting orifices 10B. The amount by which ink is jetted per jetting by each of the ink jetting orifices 10A is 1.4 pl, and that by each of the ink jetting orifices 10B is 2.8 pl. Each ink jetting orifice 10 is in connection to a pressure chamber 11 and ink passage 12. The pressure chamber 11 is provided with a heater (unshown). Each ink passage 12 is separated from the next ink passage 12 by an ink passage wall 13. There are multiple nozzle filters 14 in the common liquid chamber. The common liquid chamber is provided with multiple nozzle filters 14 (filtering members) for preventing particles of foreign substances from entering the nozzles. More specifically, the multiple nozzle filters 14 are arranged in the portion of the common liquid chamber, which is between the ink passage side of the ink delivery channel 9, and the hypothetical plane which coincides with the end of each ink passage wall 13 on the ink delivery channel side. They are aligned in the direction parallel to the lengthwise direction of the ink delivery channel 9. The nozzle filters 14 are columnar, and coincide with the hypothetical extensions of the ink passage walls 13, one for one.

Next, referring to FIGS. 4B-4E (sectional views at Planes A-A-D-D, respectively), the measurements of the various portions of the chip 3 will be described.

The ink jetting orifice 10A, that is, the orifice closer to the ink delivery channel 9, is elliptical, being 7.6 μm in short axis and 9.2 μm in long axis. The ink passage 12 and pressure chamber 11, which lead to the orifice 10A, are 12 μm and 15.2 μm, respectively, in width. The ink jetting orifice 10B, that is, the orifice farther from the ink supply passage 9, is 10.6 μm in diameter. The ink passage 12 and pressure chamber 11, which lead to the orifice 10B are 12.0 μm and 22.6 μm, respectively, in width. The orifices 10A, which jet 1.4 pl of ink per jetting, and the orifices 10B, which jet 2.8 pl of ink per jetting, are arranged so that in terms of the direction parallel to the row of orifices 10A and the row of orifices 10B, the orifices 10A and 10B are alternately positioned (they are arranged in zig-zag pattern). In terms of the abovementioned direction, the pitch of the ink jetting orifice 10 of chip 3 is 1,200 dpi; the distance between an orifice 10A and the adjacent orifice 10B is roughly 21 μm. The ink passage wall 13 is 9 μm in width. The height of the ink passage 12 is 14 μm. The orifice portion (distance between ceiling surface of pressure chamber 11 of ink passage 12 to the outer opening of orifice 10 of nozzle plate 8) is 11 μm in thickness. The thickness of the nozzle plate 8 itself is 25 μm. The nozzle filters 14 are 13 μm in diameter, and are arranged with a pitch of 1,200 dpi (roughly 21 μm in interval). There is an epoxy resin layer 17, between the nozzle plate 8 and substrate 7, which is for keeping the nozzle plate 8 adhered to the substrate 7.

Referring to FIG. 4D, designated by referential characters a, b, and c are the height of the ink passage 12, width of the ink passage wall 13, and width of the ink passage 12, respectively. There are the following relationships among them in this embodiment:

$$a>b,$$

$$c>b.$$

Satisfying the above inequalities can provide the ink passages of an ink jet recording head with sufficient height even if the ink passages are arranged at a high density. Therefore, it makes it possible for the head to tolerate the stress attributable to the temperature changes, etc. Consequently, satisfying the above inequalities makes it possible to prevent the nozzle plate 8 from separating from the substrate 7.

It is desired that an inequality: $a>c$ is satisfied, because satisfying the inequality makes it possible to deal with an ink jet recording head whose ink passage pitch is no less than 1,200 dpi.

At this time, referring to FIGS. 5-7, the effects of this embodiment will be described.

Figure 5:
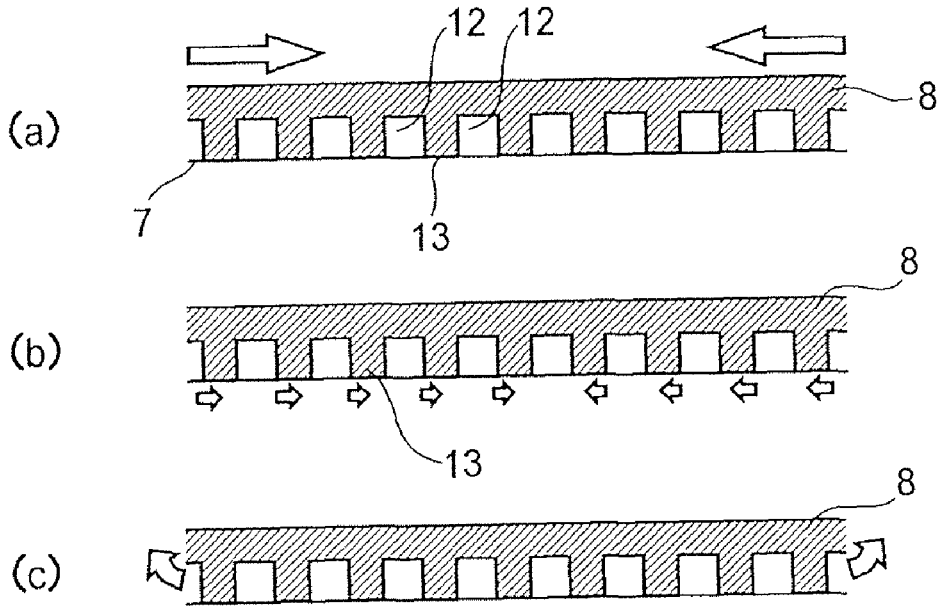
FIG. 5 is a schematic drawing for describing the effect of the present invention upon the ink jet chip in the first preferred embodiment.

FIG. 5(*a*) is a drawing equivalent to FIG. 4D, which is a sectional view of the ink jet chip, at Plane B-B in FIG. 4A, although FIG. 5(*a*) does not show the layer for adhesion improvement. The arrow marks in FIG. 5(*a*) represent the internal stress of the nozzle plate 8; the internal stress, such as that shown in the drawing, is generated in the nozzle plate 8 by the heat to which the nozzle plate is subjected during various steps in the ink jet recording head manufacturing process, changes in the temperature and humidity in the environment in which the ink jet recording head is used, and like factors. This stress is attributable to the difference in the coefficient of thermal expansion between the nozzle plate 8 and substrate 7. The coefficients of thermal expansion of the nozzle plate 8 and substrate 7 in this embodiment are roughly 60 ppm and 4 ppm, respectively. The larger the chip, the greater the internal stress which occurs in the chip. Further, the closer to the center of the chip, the greater the amount of internal stress.

The arrow marks in FIG. 5(*b*) represent the stress which occurs at the interface between the ink passage wall 13 and substrate 7. In this embodiment, the height of the ink passage 12, which is 14 μm, is greater than the width (thickness) of the ink passage wall 13, which is 9 μm, and is greater than the width of the ink passage 12, which is 12 μm. Thus, the internal stress which occurs to the nozzle plate 8 is distributed among a relatively large number of ink passage walls 13. Therefore, the stress which occurs between each ink passage wall 13 and substrate 7 is relatively small.

Therefore, it does not occur that the peripheral portions of the nozzle plate 8 separate from the substrate 7 as shown in FIG. 5(*c*).

Figure 6:
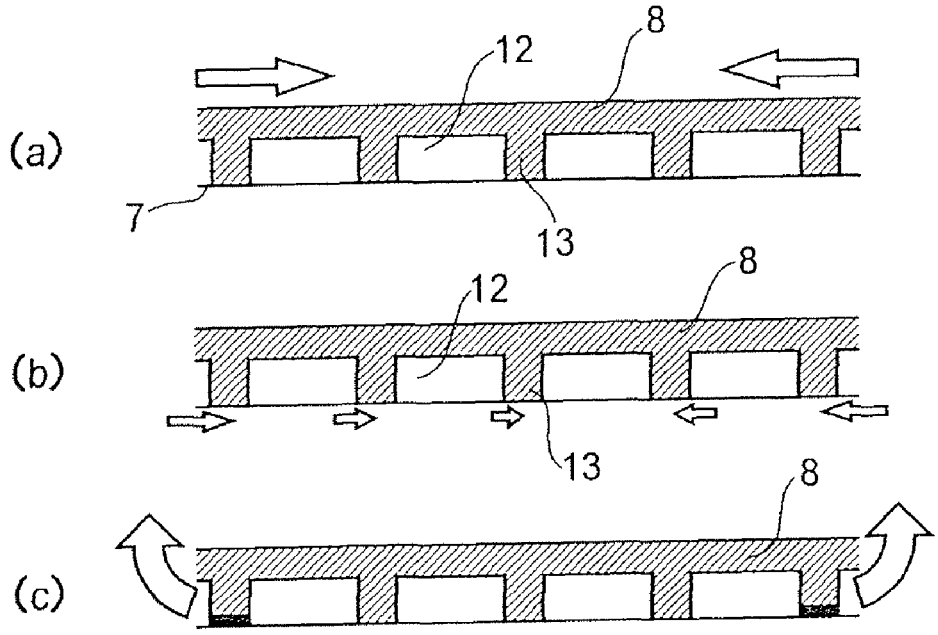
FIG. 6 is a schematic drawing for describing the separation of the nozzle plate of the first comparative ink jet recording head.

FIG. 6(*a*) is a schematic sectional view of a given section of the first comparative ink jet chip, which is equivalent to FIG. 4D, which is a sectional view of the ink jet chip in the first embodiment, at Plane B-B in FIG. 4A. In the case of the first comparative ink jet chip, the ink passages 12 are 33 μm in width, and are arranged with a pitch of 600 dpi (roughly 42 μm in interval), and the ink passage walls 13 are 9 μm in width (thickness). Further, the ink passages 12 are 14 mm in height, and the ink jetting orifice portion is 11 μm in thickness. The thickness of the nozzle plate 8 itself is 25 μm. The arrow marks in FIG. 6(*a*) represent the internal stress of the nozzle plate 8 as do the arrow marks in FIG. 5(*a*).

The arrow marks in FIG. 6(*b*) represent the stress which occurs at the interface between the ink passage wall 13 and substrate 7. In the case of this comparative ink jet chip, the height of the ink passage 12, which is 14 μm, is greater than the width (thickness) of the ink passage wall 13, which is 9 μm. However, the width of the ink passage 12, which is 33 μm, is greater than the height of the ink passage (ink passage wall 13). Thus, the internal stress which occurs to the nozzle plate 8 is distributed among a relatively small number of ink passage walls 13. Therefore, the stress which occurs between each ink passage wall 13 and substrate 7 is relatively large.

Therefore, the problem that the peripheral portions of the nozzle plate 8 separate (solid black portions in drawing) from the substrate 7 as shown in FIG. 6(*c*) occurs.

Figure 7:
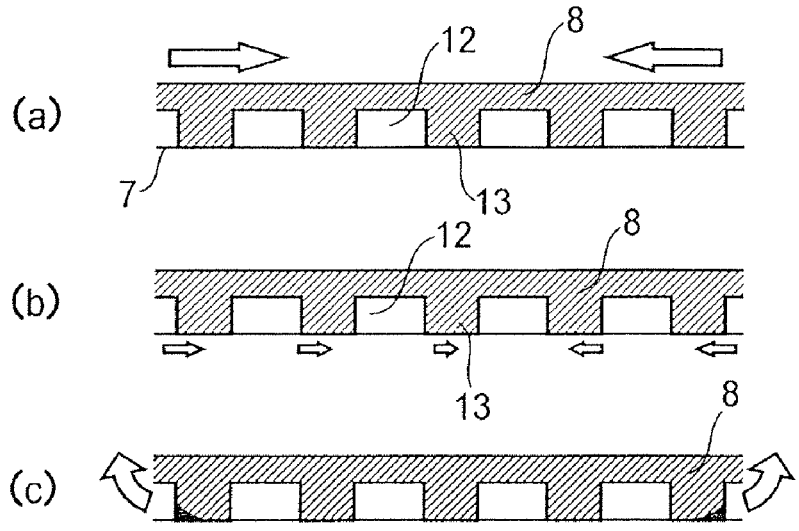
FIG. 7 is a schematic drawing describing the separation of the nozzle plate of the second comparative ink jet recording head.

FIG. 7(*a*) is a schematic sectional view of a given section of the second comparative ink jet chip (which is equivalent to FIG. 4D, which is a sectional view of the ink jet chip in the first embodiment, at Plane B-B in FIG. 4A). In the case of the second comparative ink jet chip, the ink passages 12 are 24 μm in width, and are arranged with a pitch of 600 dpi (roughly 42 μm in interval), and the ink passage walls 13 are 18 μm in width (thickness). Further, the ink passages 12 are 14 μm in height, and the ink jetting orifice portion is 11 μm in thickness. The thickness of the nozzle plate 8 itself is 25 μm. The arrow marks in FIG. 7(*a*) represent the internal stress of the nozzle plate 8 as do the arrow marks in FIG. 5(*a*).

The arrow marks in FIG. 7(*b*) represent the stress which occurs at the interface between the ink passage wall 13 and substrate 7. In the case of the second comparative ink jet chip, the width (thickness) of the ink passage wall 13, which is 18 μm, is greater than the height of the ink passage 12, which is 14 μm, and, the width of the ink passage 12, which is 24 μm, is greater than the height of the ink passage. Thus, the internal stress which occurs to the nozzle plate 8 can be absorbed to a certain degree by the ink passage walls 13. However, the ink passages 12 are arranged with a pitch of 600 dpi (roughly 42 μm in interval). Therefore, the amount of stress with which each ink passage wall is imparted is relatively large. Therefore, the problem that the portions of the nozzle plate 8, which are close to the peripheries of the chip, separate (solid black portions) from the substrate 7 as shown in FIG. 7(*c*), occurs.

As described above, in the case of the ink jet recording head in this embodiment, the width (thickness) of the ink passage wall 13, which is 9 μm, is relatively thin. However, the width of the ink passage 12, which is 12 μm, is also relatively thin. Thus, the ink passage walls 13 can be arranged with a pitch of 1,200 dpi (21 μm in interval). Therefore, the internal stresses of the nozzle plate 8 are distributed among a relatively large number of ink passage walls 13. Therefore, the ink jet recording head in this embodiment is greater in the conformity between the nozzle plate 8 and substrate 7.

Further, the width of the nozzle filters 14 is greater than the width (thickness) of the ink passage wall 13. Therefore, the nozzle filters 14 absorb, by a substantial amount, the stress which occurs at the interface between the nozzle plate 8 and substrate 7, reducing thereby the amount of stress which concentrates to the end (on ink delivery channel side) of the ink passage wall 13. In addition, this effect is enhanced by the abovementioned arrangement in which the nozzle filters 14 coincide with the hypothetical extensions of with the ink passage walls 13, one for one.

As described above, in this embodiment, the ink jet recording head is improved in terms of the adhesion of the nozzle plate 8 to the substrate 7, by preventing the internal stress, which occurs to the ink jet chip, from concentrating at the interface between the nozzle plate 8 and substrate 7.

Embodiment 2

Figure 8:
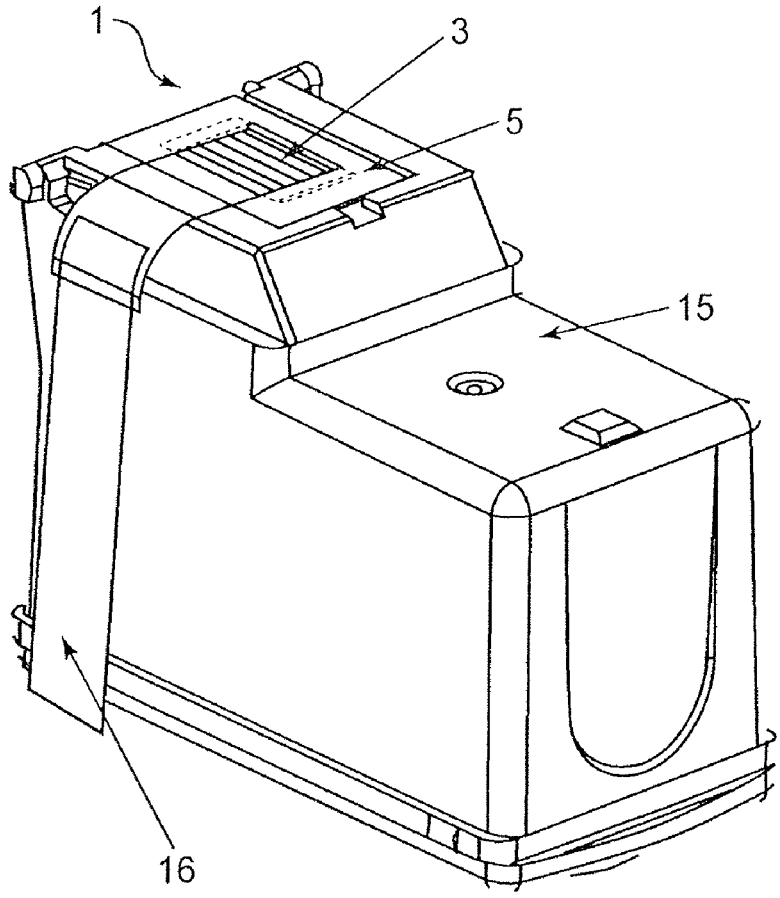
FIG. 8 is a perspective view of the ink jet recording head in the second preferred embodiment of the present invention.

FIG. 8 is a perspective view of the ink jet recording head in the second preferred embodiment of the present invention. The ink jet recording head 1 in this embodiment is provided with a chip 3, which is for jetting dye-based color inks.

The chip manufacturing method in this embodiment is virtually the same as the one in the first preferred embodiment. In this embodiment, however, the completed chip is not provided with an aluminum base, such as the one with which the chip in the first embodiment was provided. Instead, the chip in this embodiment is directly and solidly adhered to the ink container 15, and then, is connected to the TAB 5 for the transmission of electrical power and signals. Also in this embodiment, the electrical junctions and peripheries of the chip are sealed with sealant to prevent foreign substances, such as ink, from entering the chip, as it was in the first embodiment. In this embodiment, however, a container formed of a resinous substance is used as the ink container which is directly attached, and therefore, the abovementioned adhering process and sealing process are controlled so that the temperature to which the chip is exposed is no higher than 100° C.

The ink jet recording head in this embodiment is of the type which has an internal ink storage. Therefore, it is provided with a protective tape 16, which is pasted to the surface of the ink jet recording head, which has the opening of each ink jetting orifice. The chip 3 in this embodiment has three ink delivery channels 9: one for yellow ink, one for magenta ink, and one for cyan ink. The multiple nozzles (orifices) 10 are arranged on each side of each ink delivery channel 9. Each nozzle is provided with an ink jetting orifice 10, an ink chamber, and an ink passage. More specifically, the total number of nozzles of the chip 3 per ink delivery channel is 768. One half of the nozzles, or 384 nozzles, are arranged on one side of the ink delivery channel 9 with a pitch of 1,200 dpi (roughly 21 μm in interval), and the other half are on the other side of the ink delivery channel 9 with the same pitch. The chip 3 is 4.3 mm in the direction perpendicular to the lengthwise direction of the ink delivery channel 9, and 11.6 mm in the direction parallel to the lengthwise direction of the ink delivery channel 9.

Figure 9A:
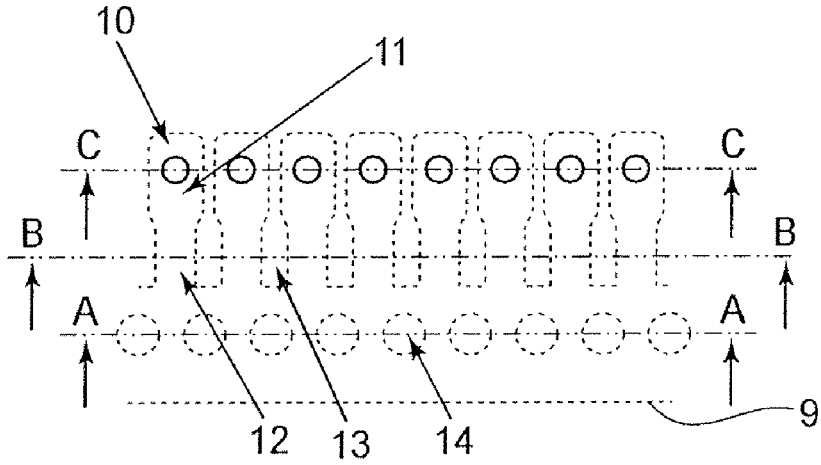
FIG. 9A is a top view of a given section of the ink jet chip in the second preferred embodiment, as seen from the top side of the nozzle formation member, showing the nozzles of the section and its adjacencies.
Figure 9B:
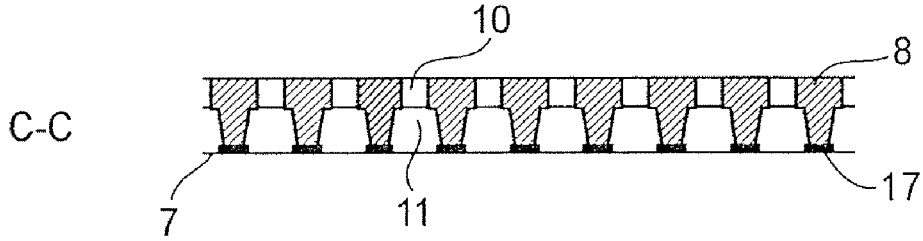
FIG. 9B is a sectional view of the same section of the ink jet chip as the one shown in FIG. 9A, at Plane C-C in FIG. 9A.
Figure 9C:
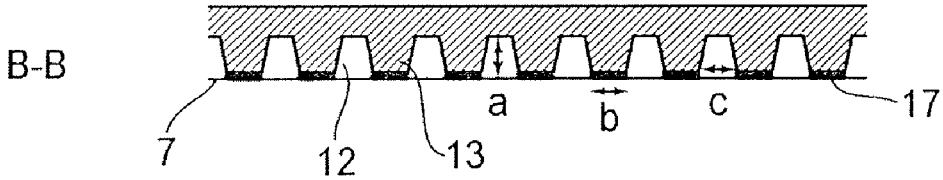
FIG. 9C is a sectional view of the same section of the ink jet chip as the one shown in FIG. 9A, at Plane B-B in FIG. 9A.
Figure 9D:
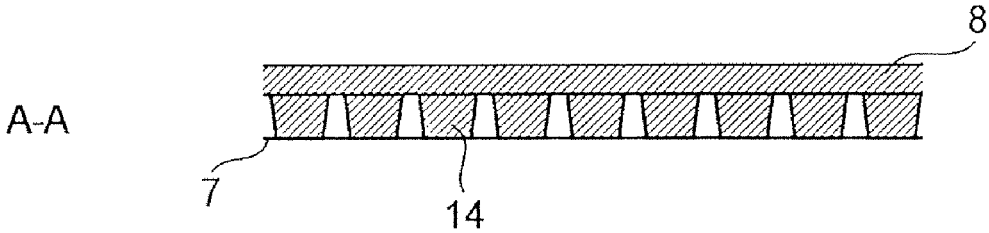
FIG. 9D is a sectional view of the same section of the ink jet chip as the one shown in FIG. 9A, at Plane A-A in FIG. 9A.
Figure 10:
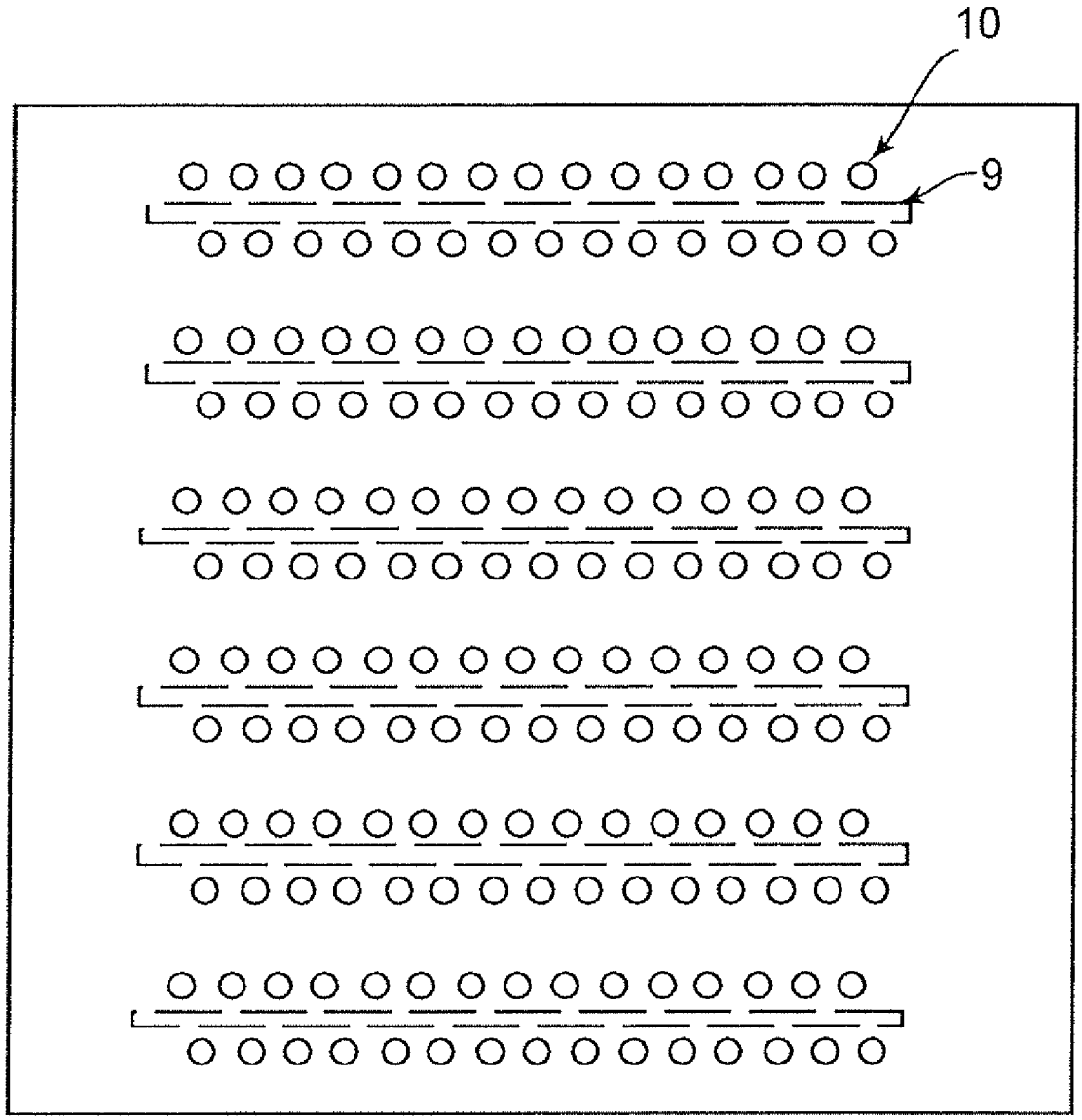
FIG. 10 is a plan view of a typical ink jet chip for an ink jet recording head, in accordance with the prior art.
Figure 11A:
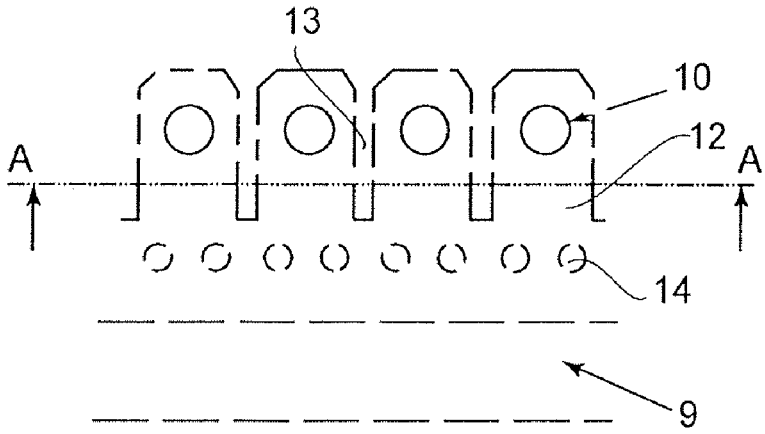
FIG. 11A is a plan view of a given section of the ink jet chip in accordance with the prior art, showing the nozzles of the section and their adjacencies.
Figure 11B:
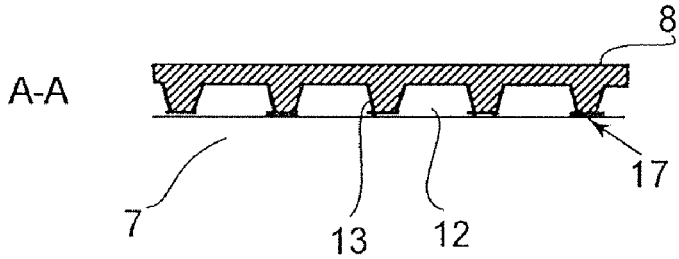
FIG. 11B is a sectional view of the same section as the one shown in FIG. 11A, at Plane A-A in FIG. 11A.
Figure 12:
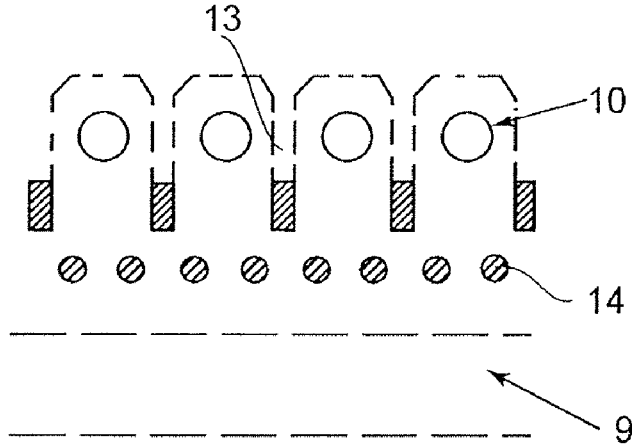
FIG. 12 is a schematic sectional view of a given section of the ink jet chip in accordance with the prior art, showing the separation of the nozzle plate 8 from the substrate 7.

FIG. 9A is a schematic top view of a given section of the chip, as seen from the top side of the nozzle plate, showing the nozzles and its adjacencies. FIG. 9B is a sectional view of the same section of the chip as the one shown in FIG. 9A, at Plane C-C in FIG. 9A. FIG. 9C is a sectional view of the same section of the chip as the one shown in FIG. 9A, at Plane B-B in FIG. 9A. FIG. 9D is a sectional view of the same section of the chip as the one shown in FIG. 9A, at Plane A-A in FIG. 9A.

Referring to FIG. 9A, each ink jetting orifice 10 is in connection to a pressure chamber 11 and ink passage 12. The pressure chamber 11 is provided with a heater (unshown). Each ink passage 12 is separated from the next ink passage 12 by an ink passage wall 13. The common liquid chamber is provided with multiple nozzle filters 14 (filtering member) for preventing particles of foreign substances from entering the nozzles. More specifically, the multiple nozzle filters 14 are arranged in the portion of the common liquid chamber, which is between the ink passage side of the ink delivery channel 9 and the hypothetical plane which coincides with the ink delivery channel side end of each ink passage wall 13. They are aligned in the direction parallel to the lengthwise direction of the ink delivery channel 9. The nozzle filters 14 are columnar, and coincide with the hypothetical extensions of the ink passage walls 13, one for one.

Next, referring to FIGS. 9B-9D (sectional views at Planes A-A-C-C, respectively), the measurements of the various portions of the chip 3 will be described.

The ink passage 12 and pressure chamber 11 are 13 μm and 15.2 μm, respectively, in width. The ink jetting orifice 10 is 8.4 μm in diameter. The ink passage 12 is 14 μm in height. The orifice portion (section of nozzle, which is between ceiling surface of pressure chamber 11 of ink passage 12 to outer opening of nozzle) is 11 mm in thickness. The thickness of the nozzle plate 8 itself is 25 μm. The nozzle filters 14 are 13 μm in diameter, and are arranged with a pitch of 1,200 dpi (roughly 21 μm in interval). In this embodiment, the ink passage walls 13 and nozzle filters 14 are shaped so that their cross-sections taper in such a manner that the top portion of each nozzle filter 14 is wider than the bottom portion. This shape is attributable to the process of forming the nozzles, etc., by etching. The angle of taper is affected by the conditions under which the substrate is etched. In this embodiment, the angle of taper is 6° on each side of the ink passage wall 13. The abovementioned width of the ink passage wall 13 and the width of the nozzle filter 14 are the widths measured at the plane which coincides with the interface between the nozzle plate 8 and substrate 7. Thus, the abovementioned width of the ink passage 12 and width of the pressure chamber 11 are also the widths measured at the plane coinciding with the interface between the nozzle plate 8 and substrate 7, and therefore, the width of the widest portion of the ink passage 12 and the width of the widest portion of the pressure chamber 11, respectively.

There is an epoxy resin layer 17, between the nozzle plate 8 and substrate 7, which is for keeping the nozzle plate 8 adhered to the substrate 7. However, there is no adhesion improvement layer between the nozzle filter 14 and substrate 7. Whether to provide the adhesion enhancement layer or not is determined according to the properties of the surface layer of the substrate 7.

In this embodiment, the portion of the surface layer of the substrate 7, which corresponds to the ink passage 12, is formed of Ta (tantalum), whereas the portion of the surface layer of the substrate 7, which corresponds to the nozzle filter 14, is formed of SiN (silicon nitride). Thus, the adhesion enhancement layer is provided only across the portions of the surface layer of the substrate 7, which are formed of tantalum.

Also in the case of the ink jet recording head in this embodiment, the ink passage walls 13 have a relatively thin width (thickness) of 10 μm. However, the ink passages 12 also have a relatively narrow width, which is 12 μm. Therefore, the ink passage walls 13 can be arranged with 21 μm intervals. Therefore, the same effects as those of the first embodiment described with reference to FIGS. 5-7 can be obtained. That is, the ink jet recording head in this embodiment is better in terms of the conformity between the nozzle plate 8 and substrate 7.

Further, the width of the nozzle filter 14 is greater than the width (thickness) of the ink passage wall 13. Therefore, a substantial portion of the stress which occurs at the interface between the nozzle plate 8 and substrate 7 is absorbed by the nozzle filters 14. Therefore, the amount of the internal stress of the nozzle plate 8, which the end portion (on ink delivery channel 9 side) is subjected, is substantially smaller than in the case of an ink jet recording head in accordance with the prior art. In addition, this effect is enhanced by the abovementioned arrangement in which the nozzle filters 14 coincide with the hypothetical extensions of the ink passage walls 13, one for one.

As described above, in this embodiment, the ink jet recording head is improved in terms of the adhesion of the nozzle plate 8 to the substrate 7, by preventing the internal stress, which occurs at the interface between the nozzle plate 8 and substrate, from concentrating.

Further, the stress which occurs to an ink jet recording head when a user peels the protective tape 16 before the ink jet recording head is used for the first time, does not concentrate. Therefore, even though the surface of an ink jet recording head, which has the openings of the ink jetting orifices, is covered with the protective tape 16 (FIG. 8) pasted thereon, the nozzle plate 8 is unlikely to separate from the substrate 7. That is, the concern that the nozzle plate 8 might separate from the substrate 7 can be removed by improving an ink jet recording head in terms of the adhesion between the nozzle plate 8 and substrate 7.

Incidentally, in the preceding preferred embodiments of the present invention described above, the ink jet recording heads were structured so that the ink passages 12 did not have stepped portions. However, the preceding embodiments are not intended to limit the present invention in scope. That is, the present invention is also effectively applicable to an ink jet recording head whose ink passages 12 have two distinctive portions different in width. For example, the present invention is effectively applicable to an ink jet recording head whose ink passages has two distinctive sections, that is, the wider section on the substrate side and the narrower section on the ink jetting orifice side. In such a case, the height of the ink passage is the sum of the heights of the wide and narrow sections of the ink passage.

Also in the preceding embodiments, the ink passage pitch on each side of the ink delivery channel was 1,200 dpi. However, this ink passage pitch is not intended to limit the present invention in terms of ink passage pitch. That is, the present invention is also effectively applicable to an ink jet recording head whose ink passages are arranged with a pitch of 600 dpi. Obviously, the present invention is also applicable to an ink jet recording head whose ink passages are arranged with a pitch of no less than 1,200 dpi.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 226532/2006 filed Aug. 23, 2006, which is hereby incorporated by reference herein.

What is claimed is:

1. An ink jet recording head comprising:

an element substrate;

a plurality of ejection outlets, provided on said element substrate, for ejecting ink in a direction perpendicular to said element substrate;

a nozzle formation member having a plurality of ink flow paths which are in fluid communication with said ejection outlets, respectively;

an ink supply port, formed through said element substrate, for supplying the ink to said ink flow paths, and filter members provided between said ink supply port and an ink supply port side end of said ink flow paths, wherein said ink flow paths are arranged at a density higher than 1200 dpi in an arranging direction of said ejection outlets, wherein widths of flow passage walls forming said ink flow paths are smaller than heights of said ink flow paths and widths of said ink flow paths are smaller than the heights of said ink flow paths, and wherein each of said filter members has a width larger than the widths of said flow passage walls.

2. An ink jet recording head according to claim 1, wherein the widths of said flow passage walls are smaller than the widths of said ink flow paths.

* * * * *